US010697131B1

(12) United States Patent
Burke

(10) Patent No.: US 10,697,131 B1
(45) Date of Patent: Jun. 30, 2020

(54) ATHLETIC PLAY SURFACE

(71) Applicant: Richard L. Burke, Chattanooga, TN (US)

(72) Inventor: Richard L. Burke, Chattanooga, TN (US)

( * ) Notice: Subject to any disclaimer, the term of this patent is extended or adjusted under 35 U.S.C. 154(b) by 0 days.

(21) Appl. No.: 16/553,914

(22) Filed: Aug. 28, 2019

Related U.S. Application Data

(60) Provisional application No. 62/822,335, filed on Mar. 22, 2019.

(51) Int. Cl.

| | |
|---|---|
| ***E01C 13/06*** | (2006.01) |
| ***A63C 19/00*** | (2006.01) |
| ***E01C 11/00*** | (2006.01) |
| ***E01C 19/00*** | (2006.01) |

(52) U.S. Cl.
CPC ..... *E01C 13/06* (2013.01); *A63C 19/00* (2013.01); *E01C 11/005* (2013.01); *E01C 19/00* (2013.01)

(58) Field of Classification Search
CPC ..... E01C 13/00; E01C 13/06; E01C 13/045; E01C 13/10; B32B 7/00; B32B 7/12; B32B 9/00; B32B 9/042; B32B 5/26
USPC ..... 472/85–87, 92, 94; 428/95
See application file for complete search history.

(56) References Cited

U.S. PATENT DOCUMENTS

| | | | | |
|---|---|---|---|---|
| 5,352,158 | A * | 10/1994 | Brodeur, Jr. | B32B 5/22 472/92 |
| 5,749,787 | A * | 5/1998 | Jank | A63C 19/04 404/32 |
| 7,186,450 | B2 * | 3/2007 | Foxon | E01C 13/08 428/86 |
| 7,279,212 | B2 * | 10/2007 | Foxon | B32B 5/26 428/95 |
| 2012/0178542 | A1 * | 7/2012 | Culleton | E01C 13/02 472/92 |
| 2018/0200608 | A1 * | 7/2018 | Sadick | B32B 9/042 |

* cited by examiner

*Primary Examiner* — Kien T Nguyen
(74) *Attorney, Agent, or Firm* — Chambliss, Bahner & Stophel, P.C.

(57) ABSTRACT

An athletic play surface having a moisture-resistant substrate layer located on top of a base surface. A woven scrim layer is positioned on top of and adhered to the substrate layer. A plurality of open cells extend through the scrim layer. An encapsulation layer is formed using a flowable curable material that is poured over the scrim layer and that hardens. The curable material passes through the open cells of the scrim layer, contacts the base surface, and then substantially fills the plurality of open cells of the scrim layer. A portion of the encapsulation layer extends beyond a top of the scrim layer to a height H. A decorative layer, such as paint and court lines, may be applied on top of the encapsulation layer.

18 Claims, 3 Drawing Sheets

ATHLETIC PLAY SURFACE

CROSS-REFERENCE TO RELATED APPLICATIONS

This application claims the benefit of U.S. Provisional Patent Application No. 62/822,335, filed on Mar. 22, 2019 and entitled PICKLE BALL GAME SURFACE, which is incorporated herein by reference in its entirety.

FIELD

The invention relates generally to play surfaces for athletics. More particularly, the present invention relates to a method for forming an athletic play surface that may be used in residential, commercial, or other applications, include those used in pickle ball and the like.

BACKGROUND

Pickle ball is a game that incorporates elements of tennis, ping pong, and badminton. It is played on a badminton-sized court, where two or four players strike a perforated ball with rackets over a stretched net that is slightly shorter than a tennis net. Like tennis, the game starts by hitting the ball across the net from behind a baseline, a line drawn on the court that is parallel with and is spaced furthest from the net. The ball must be hit across the court and into the opposing team's service court, which is one of two rectangular sections located at the rear of the other team's half of the court. After the ball is served, the opposing team must allow the ball to bounce once in their service court before hitting it back over the net. Similarly, the serving team must also allow the ball to bounce once on their side of the court before hitting it back over the net. This is known as the "double bounce" rule. Once the double bounce rule is met, teams hit the ball back and forth over the net while it is in the air or after it has bounced once on their side of the court. Play continues in this manner until one team hits the ball into the net or out of bounds or allows the ball to bounce twice on their side of the court.

Many athletic play surfaces, including those used in sporting events such as pickle ball, are designed to be shock absorbing in order to reduce the likelihood of participant injury and to reduce fatigue. These athletic play surfaces often incorporate a variety of materials in order to achieve the desired shock-absorbing characteristics, provide a long useful life, facilitate cost-effective repair, etc. The cost of the initial construction of athletic play surfaces, such as tennis courts, basketball courts, pickle ball courts, etc. can be substantial. The ongoing costs of maintaining the athletic play surfaces as a result of deterioration and wear can be high as well. As the athletic play surface is used, any painted surface may have to be redrawn or repainted. However, in some cases, more substantial surface defects, such as cracks, loose areas, bumps, etc. develop. These types of surface defects can cause the ball to bounce or roll improperly, such that the play area might be unsafe and play is made more difficult. While certain minor surface defects can be patched through simple surface repairs, more extensive defects often require a complete replacement or resurfacing of the play area, and cannot simply be re-painted or patched.

One contributor to the costs of new construction is site preparation, which requires a large enough area to be cleared and prepared for a court surface to be laid. One way to reduce this cost would be to place a court over an area that has already been cleared and is sufficiently compacted, such as a concrete roof area, asphalt or concrete parking area, etc. A contributor to the costs of ongoing maintenance is breaking up and removing the existing or prior athletic play surface. This cost could be reduced or eliminated by simply placing a new court over the pre-existing surface.

Accordingly, what is needed is a method for forming an athletic play surface that addresses the above-described problems.

OBJECTS OF THE INVENTION

It is therefore an object of this invention to provide materials for an athletic play surface, such as a pickle ball court, which can be applied over existing asphalt and concrete pavements and is particularly well adapted for use. Another object of the present invention is to provide a surface which will resist moisture intrusion from below. Another object of the invention is to provide an athletic play surface that requires minimal maintenance. Another object of the invention is to provide an athletic play surface that can be economically repaired in the event of physical damage. It is also an object of the present invention to provide for an athletic play surface that can retrofitted over an existing cleaned surface, such as a pre-existing athletic play surface, in a short period of time with minimal down time

NOTES ON CONSTRUCTION

The use of the terms "a", "an", "the" and similar terms in the context of describing embodiments of the invention are to be construed to cover both the singular and the plural, unless otherwise indicated herein or clearly contradicted by context. The terms "comprising", "having", "including" and "containing" are to be construed as open-ended terms (i.e., meaning "including, but not limited to,") unless otherwise noted. The terms "substantially", "generally" and other words of degree are relative modifiers intended to indicate permissible variation from the characteristic so modified. The use of such terms in describing a physical or functional characteristic of the invention is not intended to limit such characteristic to the absolute value which the term modifies, but rather to provide an approximation of the value of such physical or functional characteristic.

Terms concerning attachments, coupling and the like, such as "attached", "connected", "mounted" and "interconnected", refer to a relationship wherein structures are secured or attached to one another either directly or indirectly through intervening structures, as well as both moveable and rigid attachments or relationships, unless otherwise specified herein or clearly indicated as having a different relationship by context. The term "operatively connected" is such an attachment, coupling or connection that allows the pertinent structures to operate as intended by virtue of that relationship.

The terms "base surface" and "poured surface" are used interchangeably and include: paved surfaces, including Portland cement concrete or asphalt pavement; a layer of compacted clay, crushed stone, dirt, and the like. The base surface or poured surface may be placed on top of a subbase layer of un-compacted clay, dirt, and the like; gravel, rock, and the like; or it may be placed onto an unmodified ground surface. The term "subbase" means a layer of material positioned under a base surface or poured surface. The term "damaged" when used in "damaged base surface" or "damaged poured surface" means the surface is physically damaged, including by being cracked, deteriorated, worn, loose, etc., so that re-surfacing the top surface (e.g., painting) is insufficient to render the surface suitable for its intended use.

The use of any and all examples or exemplary language (e.g., "such as" and "preferably") herein is intended merely to better illuminate the invention and the preferred embodiments thereof, and not to place a limitation on the scope of the invention. Nothing in the specification should be construed as indicating any element as essential to the practice of the invention unless so stated with specificity.

SUMMARY

The above and other needs are met by a method for constructing an athletic play surface on a base surface. According an embodiment of the method, a moisture-resistant substrate layer is first provided on top of the base surface. The substrate layer is then covered with a woven scrim layer. Lastly, the scrim layer is covered with a flowable curable material that passes through open cells formed in the scrim layer and contacts the substrate layer, substantially filling the open cells of the scrim layer, to form an encapsulation layer having a portion with height H that extends beyond a top of the scrim layer.

According to certain embodiments, a decorative layer is provided on a top surface of the encapsulation layer. The decorative layer may be applied before the curable material has dried and hardened. In certain embodiments, a top surface of the encapsulation layer is sanded. Certain embodiments of the method also require providing the base surface on an existing subbase surface as an initial step. In some embodiments, the base surface is an existing poured surface comprising a curable material that is damaged. According to certain embodiments, the woven scrim layer is adhered to the substrate layer with an adhesive prior to covering the scrim layer with the flowable curable material. According to certain embodiments, height H substantially the entire portion of the encapsulation layer extends beyond a top of the scrim layer to a level at height H that is substantially uniform.

Certain embodiments of the method require placing two moisture-resistant substrate layers adjacent one another on top of the base surface, and then placing a first adhesive strip having a first width over at least a portion of an abutment formed by the two adjacent substrate layers in order to join them together. Certain preferred embodiments of the method further require placing a second adhesive strip having a second width, where the second width is wider than the first width, over the first adhesive strip to substantially cover the first adhesive strip and the underlying abutment with the second adhesive strip.

Also disclosed herein is an athletic play surface configured for placement on top of a base surface. The athletic play surface comprises a moisture-resistant substrate layer that is positioned on top of the base surface. The moisture-resistant substrate layer may be formed of a fabric having at least one of a moisture-resistant coating or a moisture-resistant backing surface applied to the fabric. In certain embodiments, one or more pairs of moisture-resistant strips are positioned adjacent one another at an abutment on top of the base surface to form the substrate layer. In those cases, a first adhesive strip with a first width is positioned over the abutment formed by each adjacent pair of moisture-resistant strips and joins the moisture-resistant strips together. Preferably, the first adhesive strip is water resistant and resists water passing between the two adjacent moisture-resistant strips at the abutment. Certain preferred embodiments further include a second adhesive strip, having a second width, which is placed over the first adhesive strip. Preferably, the second width is wider than the first width such that the first strip is covered substantially entirely by the second strip.

A woven scrim layer is positioned on top of the substrate layer. A plurality of open cells extend through the scrim layer. An encapsulation layer is formed with a flowable curable material that is deposited onto the scrim layer. In some embodiments, the curable material comprises fiber-reinforced Portland cement concrete. The curable material passes through the plurality of open cells formed in the scrim layer, contacts the substrate layer, and substantially fill the plurality of open cells of the scrim layer prior to curing. A portion of the encapsulation layer extends beyond a top of the scrim layer and has a height H.

BRIEF DESCRIPTION OF THE DRAWINGS

Further advantages of the invention are apparent by reference to the detailed description when considered in conjunction with the figures, which are not to scale so as to more clearly show the details, wherein like reference numerals represent like elements throughout the several views, and wherein.

DETAILED DESCRIPTION

Figure 1:
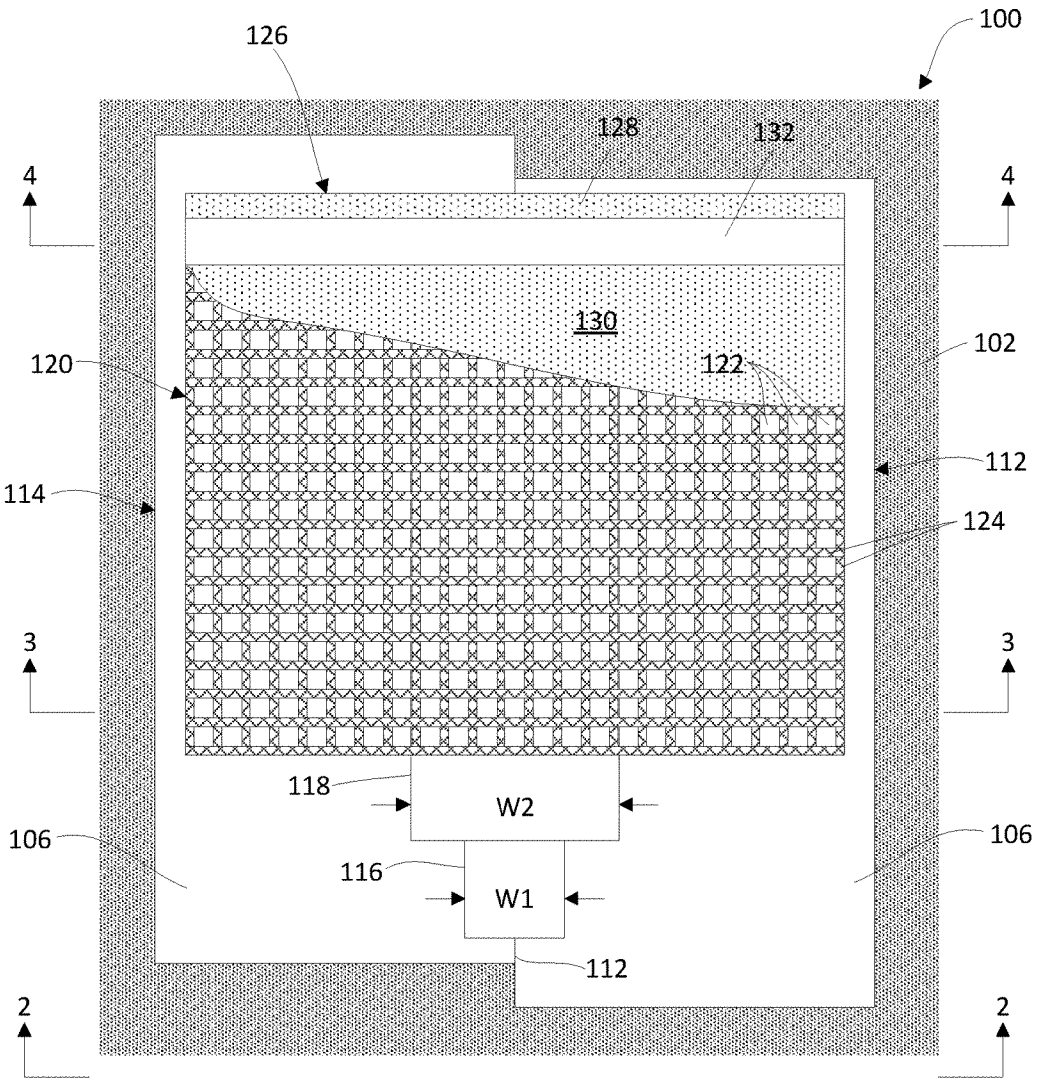
FIG. 1 is a top plan view depicting a section of an athletic play surface according to an embodiment of the present invention.
Figure 2:
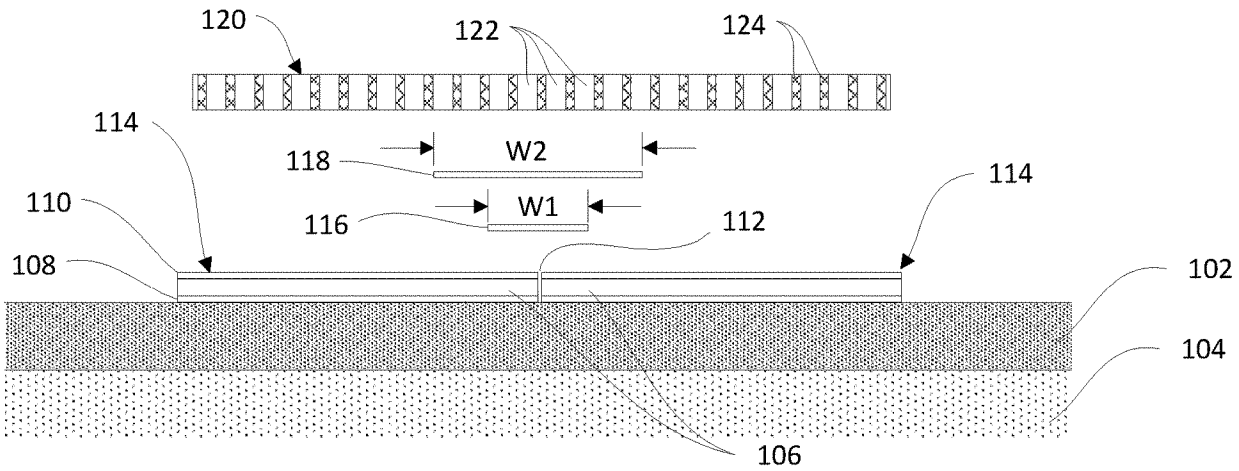
FIG. 2 is an exploded view of a portion of the athletic play surface of FIG. 1 taken along line "2-2"
Figure 3:
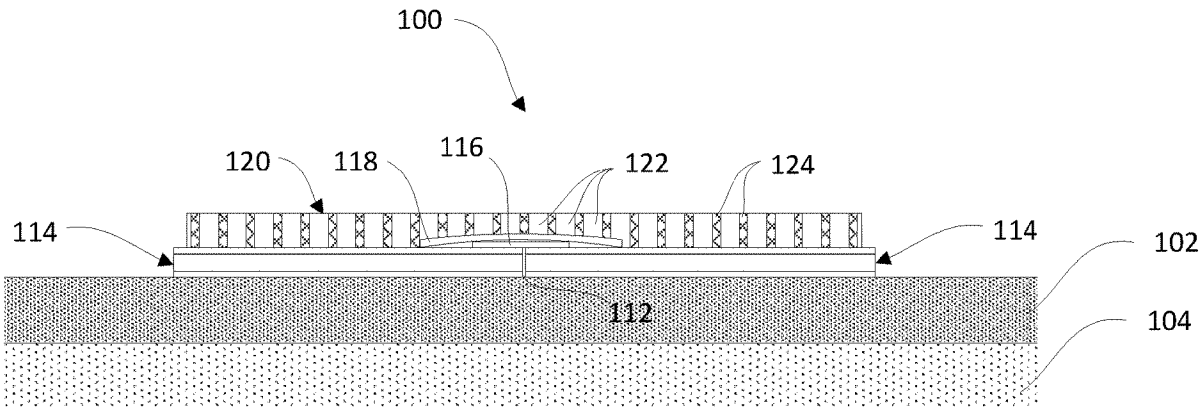
FIG. 3 is a section view of a portion of the athletic play surface of FIG. 1 taken along line "3-3"
Figure 4:
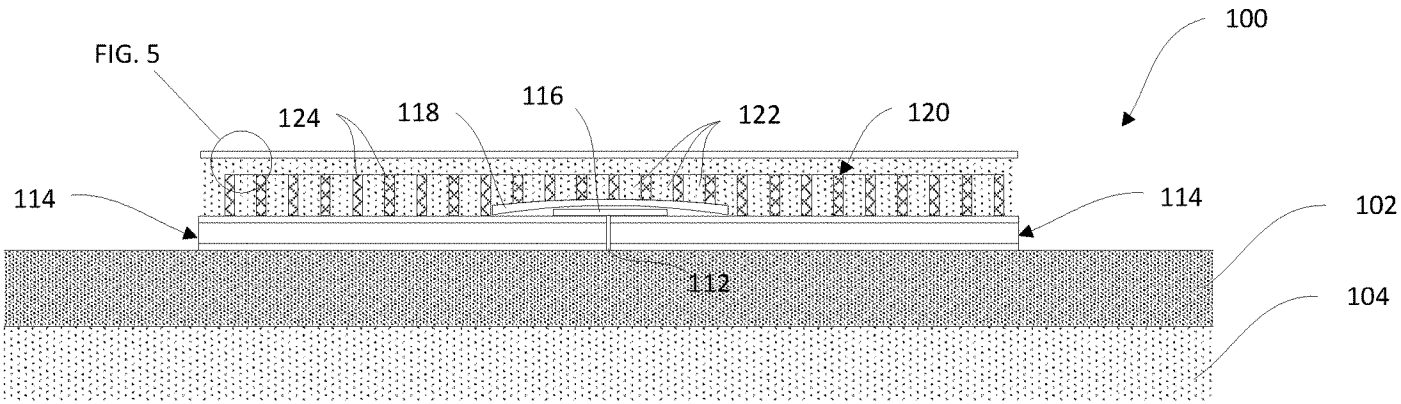
FIG. 4 is a section view of the athletic play surface of FIG. 1 taken along line "4-4"
Figure 5:
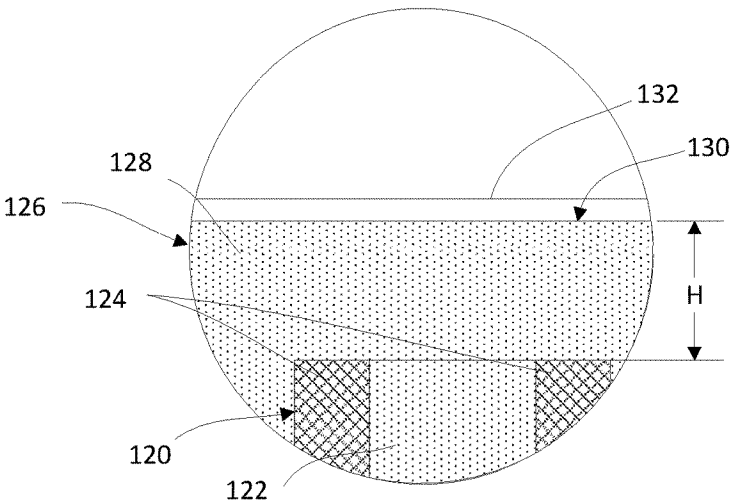
FIG. 5 is a detail view showing the circled portion of the athletic play surface in FIG. 4 denoted by "FIG. 5."

Referring now to FIGS. 1-5, there is provided poured athletic play surface 100 constructed according to the method of the present invention. In certain preferred embodiments, poured athletic play surface 100 is placed on top of existing base surface 102 that has been damaged and that is located on top of subbase 104. For example, existing base surface 102 could be a cracked asphalt or concrete, such as a parking lot or existing play surface (e.g., basketball court, tennis court, or the like), located on subbase 104 of stabilized soil. Advantageously, constructing play surface 100 does not require the expense of first breaking up and removing the existing and damaged base surface. Instead, as detailed herein, play surface 100 may be placed directly onto base surface 102. Play surface 100 may also be constructed where only subbase 104 is located. In that case, base surface 102 is created on top of existing subbase 104 through compacting the existing subbase material, by building the base surface using new materials (e.g., dumping crushed stone or gravel onto a dirt subbase surface, and compacting the added material), or other similar site preparation functions, as necessary to provide a suitable base surface.

According to a preferred embodiment of the invention, one or more pairs of moisture-resistant fabric strips 106 are arranged on top of base surface 102. In certain preferred embodiments, each of the fabric strips 106 is formed by a fabric layer that is at least 0.125 inches thick and includes moisture-resistant coating 108 (such as urethane, epoxy, resin, or other polymeric coating etc.) applied to the fabric layer, moisture-resistant backing layer 110 (such as a woven polypropylene and polyester fabric impregnated with liquid urethane) affixed to the fabric layer, or both. However, coating 108 or backing layer 110 may be applied to the top of the strips 106. Additionally, coating 108 may be dispersed throughout the strips 106, including between the top and bottom surfaces. Strips 106 are arranged such that side edges of each strip is adjacent a side edge of an adjacent strip to form an abutment 112 (excluding the outermost strips, where only one side edge is adjacent the side edge of the nearest strip) to form a moisture-resistant fabric substrate layer 114.

A first adhesive water-resistant strip 116, such as moisture-proof tape, is then placed over the abutment 112. Each first strip 116 has a first width W1 that is sufficiently wide enough to span the abutment 112 and to join the two adjacent fabric strips 106 together. In certain preferred embodiments, a second adhesive strip 118 having a second width W2, where the second width (e.g., 6 inches to 18 inches) is wider than the first width W1 (e.g., 3 inches to 8 inches wide), is placed over the first adhesive strip. Preferably second width W2 is wide enough that first strip 116 is covered entirely by second strip 118 to provide a double layer of water-resistant strips placed over each abutment 112. In some embodiments, strips 116, 118 are formed using the same materials. However, in other embodiments, strips 116, 118 are formed using different materials with different material properties. For example, first strip 116 may be formed using a flexible waterproof tape that permits fabric strips 106 to move or flex. However, second strip 118 may be formed using a rigid tape, such as fiberglass tape, that provides rigidity and a stable surface on top of fabric strips 106 and first strip 116. Preferably, adhesive water-resistant strips 116, 118 resist water passing upwards from base surface 102 or subbase 104 between the two adjacent moisture-resistant fabric strips 116 at abutment 112. As a result of this water resistance, play surface 100 resists moisture from below and, therefore, can be constructed on moisture-laden base surfaces 102, such as concrete roof areas and the like.

Next, an open weave scrim layer 120 is placed on top of substrate layer 114 and adhesive strips 116, 118. Preferably, scrim layer 120 is adhered to substrate layer 114 with a liquid, water-based, free-flowing adhesive (not shown). In certain embodiments, scrim layer 120 is formed by twisted fiber strands of natural materials, synthetic materials, or both that are woven together. For example, scrim layer 120 may be formed from fiberglass, polypropylene, or other synthetic fabrics. Scrim layer 120 may be formed by separate strips that are connected together. For example, in one embodiment, scrim layer 120 is formed using multiple strips that are each 24-40 inches wide by 100-150 feet wide and are placed adjacent one another. Scrim layer 120 is provided with a plurality of open cells 122 located between the woven fibers or strands 124 that extend throughout the scrim layer.

An encapsulation layer 126 (not shown in FIGS. 2 and 3) is the top layer of athletic play surface 100 and is formed by covering the scrim layer 120 with a flowable curable material 128, such as self-curing Portland cement concrete. In a preferred embodiment, the curable material 128 is a self-curing cement or cementitious mixture that is preferably comprised of approximately 10 percent to approximately 95 percent sand by volume. Preferably, the sand has a particle size that is smaller than #12 U.S. screen mesh size. In other embodiments, fine sand has a particle size that is less than #40 U.S. screen mesh size and greater than #120 U.S. screen mesh size. In certain preferred embodiments, the curing material 128 comprises sand particles and other aggregate that are bound by a mixture of cement and a latex binder. For example, in one preferred embodiment, curable material 128 is comprised of approximately 10% Portland cement, approximately 18% latex binder, and approximately 72% sand, by weight. In certain embodiments, curing material 128 is fiber-reinforced concrete that is reinforced, for example, with carbon, steel, glass, synthetic, natural or other fibers mixed into the concrete mix.

Preferably, encapsulation layer 126 is formed by pouring and spreading curable material 128 over scrim layer 120 such that the curable material passes into and substantially fills open cells 124. As curable material 128 is poured over scrim layer 120, it flows down through cells 124 and preferably contacts poured base surface 102, fills open cells 124, and then forms a portion that extends to a top surface 130. Encapsulation layer 126 extends from the top of substrate layer 124 to top surface 130. Preferably, the upper portion of the encapsulation layer 126 that is located between the top of the scrim layer 120 and top surface 130 has a height H. Preferably, height H is uniform across the entire surface of encapsulation layer 126. In certain embodiments, height H ranges from about 0.125 inches to about 0.25 inches. Even more preferably, the overall thickness of the entire encapsulation layer 126 has a uniform thickness (i.e., the distance from the top of substrate layer 124 to top surface 130).

Scrim layer 120 is configured with open cells 122 being sized such that curable material 128 flows easily into the open cells, but the cells are not so large that the curable materials slumps or is uneven when cured (e.g., side lengths ranging from 0.3 inches to 1.0 inches in a rectangular cell). Open cells 122 may be rectangular in shape, including square-shaped, or any other suitable shape (e.g., round). For example, in a preferred embodiment, scrim layer 120 is formed using a furred fiberglass mesh having rectangular open cells 122 with side lengths of 0.5 inches and 0.75 inches (0.375 square inches). Advantageously, fiberglass mesh will not rust like metal meshes. Additionally, fiberglass is lighter and easier to handle than metal meshes. Scrim layer 120 is furred so that portions of the scrim layer are held above (i.e., away from) the substrate layer 114. For example, a scrim layer 120 having a thickness of 0.04 inches is furred to provide an overall thickness of 0.12 inches, which provides a constant depth above substrate layer 114. The constant depth of the scrim layer 120 also assists in providing a constant thickness once the curable material 128 fills the open cells 122 (e.g., an encapsulation layer 126 having a 0.2 inches overall thickness using a 0.12 inches thick scrim layer). If the cured encapsulation layer 126 has an initial overall thickness of 0.2 inches, the top surface 130 may be sanded down until uniform and the final sanded encapsulation layer is 0.16 inches thick.

Once the encapsulation layer 126 has cured, its top surface 130 may be sanded smooth and level in order to prepare the surface for use. Additionally, a decorative layer 132 may be applied to top surface 130 of encapsulation layer 126. This decorative layer 132 may include the paint, lines, tape, etc. required to form a pickle ball court, tennis court, basketball court, etc. In certain embodiments, decorative layer 132 is applied after the curing process of curable material 128 has finished. In other embodiments, decorative layer 132 is applied before the curable material 128 has dried and hardened.

Although this description contains many specifics, these should not be construed as limiting the scope of the invention but as merely providing illustrations of some of the presently preferred embodiments thereof, as well as the best mode contemplated by the inventor of carrying out the invention. The invention, as described herein, is susceptible to various modifications and adaptations as would be appreciated by those having ordinary skill in the art to which the invention relates.

What is claimed is:

1. A method for constructing an athletic play surface on a base surface comprising the steps of:

A. providing a moisture-resistant substrate layer on top of the base surface;

B. covering the substrate layer with a woven scrim layer;

C. covering the scrim layer with a flowable curable material that passes through open cells formed in the scrim layer and that contacts the substrate layer, substantially fills the open cells of the scrim layer, and forms an encapsulation layer having a portion with height H that extends beyond a top of the scrim layer;

D. placing two moisture-resistant substrate layers adjacent one another on top of the base surface; and E. placing a first adhesive strip having a first width over at least a portion of an abutment formed by the two adjacent substrate layers in order to loin them together.

2. The method of claim 1 further comprising providing a decorative layer on a top surface of the encapsulation layer.

3. The method of claim 2 wherein the decorative layer is applied before the curable material has dried and hardened.

4. The method of claim 1 further comprising sanding a top surface of the encapsulation layer.

5. The method of claim 1 further comprising providing said base surface on an existing subbase surface prior to Step A.

6. The method of claim 1 wherein the base surface is a damaged poured surface.

7. The method of claim 1 further comprising adhering the woven scrim layer to the substrate layer with an adhesive.

8. The method of claim 1 further comprising the step of placing a second adhesive strip having a second width, where the second width is wider than the first width, over the first adhesive strip to substantially cover the first adhesive strip with the second adhesive strip.

9. The method of claim 1 wherein height H is substantially uniform across the encapsulation layer.

10. An athletic play surface configured for placement on top of a base surface, the athletic play surface comprising:

a moisture-resistant substrate layer disposed on top of the base surface;

a woven scrim layer disposed on top of the substrate layer;

a plurality of open cells extending through the scrim layer;

an encapsulation layer having a portion with height H that extends beyond a top of the scrim layer, the encapsulation layer formed by a flowable curable material that is configured to pass through the plurality of open cells formed in the scrim layer in order to contact the substrate layer and to substantially fill the plurality of open cells of the scrim layer prior to curing;

one or more pairs of moisture-resistant strips disposed adjacent one another at an abutment on top of the base surface to form said substrate layer;

a first adhesive strip with a first width disposed over the abutment formed by each adjacent pair of moisture-resistant strips joining the moisture-resistant strips together, wherein the first adhesive strip is water resistant and resists water passing between the two adjacent moisture-resistant strips at the abutment.

11. The athletic play surface of claim 10 further comprising a second adhesive strip having a second width disposed over the first adhesive strip, wherein the second width is wider than the first width such that the first strip is covered substantially entirely by the second strip.

12. The athletic play surface of claim 10 wherein each of the plurality of open cells has a minimum open area of 0.09 square inches (in.$^2$) and a maximum open area of 1.0 square inches (in.$^2$).

13. The athletic play surface of claim 10 wherein each of the plurality of open cells is substantially rectangular in shape with a minimum side length of 0.3 inches and a maximum size length of 1.0 inches.

14. The athletic play surface of claim 10 wherein height H is 0.125 inches or greater.

15. The athletic play surface of claim 10 wherein the curable material is comprised of 10-95% sand by volume.

16. The athletic play surface of claim 10 wherein the curable material comprises fiber-reinforced concrete.

17. The athletic play surface of claim 10 wherein the moisture-resistant substrate layer is composed of a fabric and at least one of a moisture-resistant coating or moisture-resistant backing surface applied to the fabric.

18. A method for replacing a damaged poured surface disposed on a subbase surface with a new poured surface without removing the damaged poured surface, the method comprising the steps of:

A. placing one or more pairs of moisture-resistant fabric strips adjacent one another along an abutment to form a moisture-resistant fabric substrate layer on top of the existing damaged poured surface, each moisture-resistant fabric strip composed of a fabric layer with a thickness of at least 0.125 inches and at least one of a moisture-resistant coating applied to the fabric layer or a moisture-resistant backing layer affixed to the fabric layer;

B. placing an adhesive water-resistant strip over the abutment formed by each adjacent pair of moisture-resistant fabric strips, wherein the adhesive water-resistant strip resists water passing upwards from the existing damaged poured surface between the two adjacent moisture-resistant fabric strips at the abutment;

C. placing a woven scrim layer that is provided with a plurality open cells on top of the substrate layer;

D. covering the woven scrim layer with a self-curing concrete-sand mixture that is comprised of 10-95% sand by volume and that passes through open cells formed in the scrim layer, contacts the existing damaged poured surface, substantially fills the open cells of the scrim layer, and forms an encapsulation layer having a portion that extends past a top of the scrim layer and that has a substantially uniform height H of at least 0.125 inches;

E. sanding a top surface of the encapsulation layer; and

F applying a decorative layer over the top surface of the encapsulation layer.

* * * * *